US006314941B1

(12) United States Patent
Gant et al.

(10) Patent No.: US 6,314,941 B1
(45) Date of Patent: Nov. 13, 2001

(54) REPROGRAMMABLE ELECTRONIC STEP TIMING CONTROL SYSTEM FOR CONTROL OF INJECTION TIMING IN A HYDROMECHANICAL FUEL SUPPLY SYSTEM

(75) Inventors: Gary L. Gant; Brian W. Robinson; Jon Padfield; George L. Muntean, all of Columbus, IN (US)

(73) Assignee: Cummin Engine Company, Inc., Columbus, IN (US)

( * ) Notice: Subject to any disclaimer, the term of this patent is extended or adjusted under 35 U.S.C. 154(b) by 0 days.

(21) Appl. No.: 09/516,438

(22) Filed: Mar. 1, 2000

(51) Int. Cl.[7] ..... F02M 33/04
(52) U.S. Cl. ..... 123/446; 123/500
(58) Field of Search ..... 123/500–1, 502, 123/446–7, 510, 511

(56) References Cited

U.S. PATENT DOCUMENTS

| | | | | |
|---|---|---|---|---|
| 3,951,117 | | 4/1976 | Perr | 123/139 |
| 4,206,734 | | 6/1980 | Perr et al. | 123/139 |
| 4,249,499 | | 2/1981 | Perr | 123/502 |
| 4,379,332 | | 4/1983 | Busser et al. | 364/431.05 |
| 4,395,979 | | 8/1983 | Perr | 123/90.16 |
| 4,402,456 | * | 9/1983 | Schneider | 239/95 |
| 4,418,867 | * | 12/1983 | Sisson | 239/88 |
| 4,463,901 | | 8/1984 | Perr et al. | 239/95 |
| 4,751,633 | | 6/1988 | Henn et al. | 364/200 |
| 4,909,219 | | 3/1990 | Perr et al. | 123/456 |
| 5,024,200 | | 6/1991 | Free et al. | 123/501 |
| 5,033,442 | | 7/1991 | Perr et al. | 123/502 |
| 5,091,858 | | 2/1992 | Paielli | 364/431.12 |
| 5,121,324 | | 6/1992 | Rini et al. | 364/431.05 |
| 5,191,531 | | 3/1993 | Kurosu et al. | 364/431.05 |
| 5,372,114 | | 12/1994 | Gant et al. | 123/502 |
| 5,377,636 | * | 1/1995 | Rix et al. | 123/446 |
| 5,404,855 | * | 4/1995 | Yen et al. | 123/446 |
| 5,411,003 | | 5/1995 | Eberhard et al. | 123/502 |
| 5,438,968 | | 8/1995 | Johnson et al. | 123/446 |
| 5,629,853 | | 5/1997 | Ogawa et al. | 364/431.051 |
| 5,666,913 | | 9/1997 | Gustafson et al. | 123/90.16 |
| 5,954,029 | * | 9/1999 | Peters et al. | 123/446 |

OTHER PUBLICATIONS

Lilly, L.R.C., Leslie, Ronald C., Diesel Engine Reference Book, "Fuel Injection Systems," title and copyright pages, pp. 10/1 and 10/6, Butterworth and Co., 1984.

Product literature, Hydraulic Variable Timing Familiarization, Cummins Engine Company, Inc., Mar. 1985.

Product literature, Step Timing Control Familiarization, Cummins Engine Company, Inc., Jun. 1987.

Lannan et al., "Cummins Electronic Controls for Heavy Duty Diesel Engines", *IEEE* 88, CH2533–8, International Conference on Transportation Electronic Convergence 88, Dearborn, Michigan, Oct. 17–18, 1988.

Product literature, Operation and Maintenance Manual CENTRY™ System (PT), Cummins Engine Company, Inc., 1994.

Product literature, CELECT Plus Familiarization, Cummins Engine Company, Inc., 1996.

Cummins Service Bulletin No. 366646, M11 PT®/STC Injector Cup Cavitation Modified CENTRY® Kit Instructions, Mar. 1999.

Slide presentation, Cummins Engine Company, M11 STC Industrial Engine—Cup Tip—RPS Overview, 13 pages (undated).

* cited by examiner

*Primary Examiner*—Thomas N. Moulis
(74) *Attorney, Agent, or Firm*—Woodard, Emhardt, Naughton, Moriarty & McNett

(57) ABSTRACT

A reprogrammable electronic step timing control system having a fuel pressure threshold that is discretely variable as a function of engine speed. The fuel pressure threshold is increased for engine speeds above rated speed by a predetermined amount. A programming key is provided in a wiring harness to allow fuel pressure and speed thresholds to be readily changed.

23 Claims, 3 Drawing Sheets

REPROGRAMMABLE ELECTRONIC STEP TIMING CONTROL SYSTEM FOR CONTROL OF INJECTION TIMING IN A HYDROMECHANICAL FUEL SUPPLY SYSTEM

BACKGROUND OF THE INVENTION

This invention relates generally to fuel injection timing control and, more particularly, to step timing control of injection in hydromechanically controlled diesel engines.

Economical and yet reliable systems for adjusting injection timing automatically have long been of interest to diesel engine manufacturers as a way to help achieve acceptable emission levels, fuel economy and power as engine conditions change. Although normal, or relatively retarded, timing is appropriate for a range of engine operating conditions including medium and heavy load conditions, it results in incomplete combustion during idling and light load conditions because of relatively low cylinder pressure under such conditions, the cylinder pressure being a function of the amount of air and fuel as well as the timing of injection. Normal timing leaves a relatively short length of time for the air and fuel to mix before the onset of combustion. Also, since fuel injection with normal timing typically starts just a few degrees before the piston reaches top dead center (TDC), most of the fuel is injected, and thus most combustion occurs, after TDC as the piston moves downward and the size of the combustion chamber correspondingly decreases. The combined conditions contribute to incomplete combustion resulting in relatively low fuel economy and relatively high hydrocarbon emissions, but with relatively low nitrogen oxide emissions due to relatively low combustion temperature.

During advanced injection timing, there is more time for mixture of air and fuel and all or most of the fuel is typically injected before TDC, while the size of the combustion chamber is still decreasing. These conditions produce higher pressure and temperature resulting in more complete combustion and thus greater fuel economy and lower hydrocarbon emissions, but also resulting in high nitrogen oxide emissions except at low engine loads when relatively little fuel is being burned.

Since the timing conditions for minimum hydrocarbon emissions generally result in increased nitrogen oxide emissions, and vice versa, a compromise is typically necessary to achieve acceptable levels of both types of emissions as well as acceptable power and fuel economy under given conditions. At idling and light loads, i.e., below approximately one-fourth of full load, it is advantageous to advance the timing, whereas during medium to high load conditions it is advantageous to retard the timing.

Various types of mechanical and hydraulic timing adjustment devices have been devised both for distributor-type fuel injection systems and for unit injector systems. U.S. Pat. No. 3,951,117 to Perr, hereby incorporated by reference, discloses an example of a hydraulic link formed within the pump portion of a pump-distributor assembly to advance injection timing as a function of a fuel pressure which is responsive to engine speed and load. This patent also discloses a hydraulic link or tappet provided for the same purpose within a unit injector, i.e., an injector combining a cam-actuated pump and an injection nozzle in a single unit. In both cases the fuel itself is used as the timing fluid. The fuel supply system is a hydromechanical system including a centrifugally controlled engine speed governor and a pressure regulator. The governor establishes minimum and maximum engine speeds between which the regulator regulates the fuel pressure to the throttle as a function of engine speed. The throttle then controls the pressure of the fuel to be metered into the injectors, and the amount metered is proportionate to that fuel pressure and the metering time in accordance with the pressure-time (PT) principle.

Timing in the system of U.S. Pat. No. 3,951,117 is controlled with two control valves in a line supplying fuel to the timing chamber within which the hydraulic link is formed. One valve varies the pressure in the line as a function of engine speed; the other varies the pressure in the line as a function of load as represented by throttle position, which is considered representative of engine load because the throttle is normally manually adjusted to increase fuel pressure, and thus the quantity of fuel injected per cycle, as the load on the engine increases. The hydraulic link is variable in length as a function of the supply line pressure, and it changes the injection timing by adding to the length of a cam-actuated plunger within the pump in the pump-distributor assembly, or within the pump in the unit injector. The hydraulic link thereby changes the effective profile of the cam. Injection timing is relatively advanced with a lengthened hydraulic link and relatively retarded with a collapsed or shortened hydraulic link.

It is also known to vary injection timing mechanically, as mentioned above and as illustrated by the adjustable timing mechanism disclosed in U.S. Pat. No. 4,206,734 to Perr et al. The mechanism is designed for use with unit injectors without a hydraulic tappet but including the conventional plunger driven by a cam via a push rod, rocker arm and connecting link to the plunger. The mechanism adjusts injection timing by moving the cam end of each push rod with respect to the associated cam profile such that cam action begins earlier or later as desired.

Step timing control (STC) is a form of control in which timing adjustments are made in discrete steps rather than continuously, and it is known to have certain advantages including relative simplicity, low cost, and reliability. The Cummins PT STC unit injector system is a well-established example of an STC system providing hydraulic variable timing, having been successfully used for years with Cummins L10, M11, NT, N14 and K series engines, among others, in a variety of applications. The system provides two-step timing control with a dual-state hydromechanical control valve, and in particular a spool valve, that is actuated by fuel pressure and, when open, supplies oil from the engine lubrication system to hydraulic tappets in the injectors. The valve state is determined solely by the level of the fuel rail pressure with respect to a single predetermined threshold or switch point. The general operating characteristic of the STC valve in relation to engine load and the corresponding pressure and timing states is set forth in the following table:

| Engine Load Condition | Fuel Pressure | STC Valve | Timing |
|---|---|---|---|
| Starting and light load | Below threshold | Open | Advanced |
| Medium to high load | Above threshold | Closed | Normal |

It is also known to implement this function with a fuel pressure switch actuating a solenoid valve, as described in the Cummins Engine Company service bulletin entitled *Hydraulic Variable Timing Familiarization*. Also, as described in U.S. Pat. No. 5,411,003 to Eberhard et al., the switch point of a spool valve in an STC system of the type described above can be varied as a function of temperature-related variations in the viscosity of the oil supplied to the valve. The switch point is made variable by modifying the control valve to receive an assist pressure from a viscosity-sensitive pressure divider. An STC system with continuous speed-sensitive variation of the fuel pressure threshold has also been proposed, as disclosed in U.S. Pat. No. 4,909,219 to Perr et al. The disclosed system provides stepwise adjustment of timing as a function of both engine speed and load. Within a range of engine speeds, the fuel pressure threshold for a timing change varies continuously with engine speed. The system uses a hydromechanical fuel control circuit including a hydraulic servomechanism for timing adjustment, and its operating characteristics cannot be changed without disassembly.

While the Cummins PT STC system described above is a relatively uncomplicated system of timing control and has proven reliable in numerous applications, it has been found to be susceptible to problems such as excessive black smoke production and/or poor fuel economy in certain highly loaded, cyclical applications. More specifically, such problems have been observed in excavators and some other construction or industrial equipment in which a diesel engine is operated at rated speed to drive a hydraulic pump or a generator set, for example, which experiences frequent, substantial variations in load. Such problems have been alleviated by replacing the fuel injectors as needed. However, a solution is needed that gives the injectors a longer useful life.

There is also a need for a solution that complements existing hydromechanical fuel supply systems with minimal modifications.

SUMMARY OF THE INVENTION

The present invention meets these needs and others by providing electronic speed-sensitive control of the threshold for actuation of an STC valve in a hydromechanical fuel supply system. An electronic step timing control system according to the present invention comprises an ON-OFF solenoid valve for supplying timing fluid to a hydraulic tappet in a fuel injector and thereby advancing injection timing, and electronic circuit means for controlling the solenoid valve as a function of fuel pressure and engine speed, the electronic circuit means including a fuel pressure level detector having a threshold that is electronically variable as a function of engine speed.

According to another aspect of the present invention, the electronic step timing control system is reprogrammable by means of a programming key containing data representative of at least one desired value of the fuel pressure threshold and a desired value of a speed threshold. In the preferred embodiment the key contains data representative of multiple pressure thresholds. A programming connector is provided to receive the key when it is desired to program new threshold values into the electronic circuit means, which includes means for controlling operation of the fuel pressure level detector in accordance with the key data.

The invention is particularly but not exclusively useful in applications where a diesel engine is operated at its rated speed to drive a hydraulic pump or a generator set, for example, which experiences frequent, substantial variations in load. Engine speed above rated speed is typically regulated by a high-speed governor, e.g., as in the Cummins PTG fuel pump, such that, for a given throttle setting, the engine speed rises as the external load on the engine is decreased, and the fuel pressure is correspondingly decreased by governor action in response to the increasing engine speed. Unfortunately, as the inventors have discovered, a large hydraulic pump or electrical generator can present an inertial load to the engine that prevents the normal rapid increase in engine speed to high idle upon release of a load, and can thus delay the corresponding decrease in fuel rail pressure according to the high-speed governor characteristic just described. This phenomenon is believed to the underlying cause of the problems of excessive black smoke production and/or poor fuel economy that have heretofore been alleviated by replacement of the affected injectors.

That is, the parasitic load on the engine is believed to be the cause of the slow rail pressure decay rate and correspondingly slow response time of the hydromechanical STC valve, resulting in sustained retarded injection timing after a rapid decrease in the load on the equipment driven by the engine. It is believed that, under such conditions, the metering chamber temperature in the injector is elevated enough to increase the vapor pressure of the fuel, resulting in vapor bubble formation and cavitation damage when the bubbles collapse inside the injector nozzle. Cavitation within the injector nozzle has been identified as the immediate cause of the smoke and fuel economy problems noted above.

It is a general object of the present invention to provide improvements in step timing control.

A further object of the invention is to provide a solution to the types of problem described above.

Yet another object is to provide a low-cost addition to an existing hydromechanical fuel system providing enhanced performance under certain conditions while maintaining the general reliability and other advantages of the known system.

These and other objects and advantages of the present invention will be more apparent upon reading the following detailed description of the preferred embodiment in conjunction with the accompanying drawings.

DETAILED DESCRIPTION OF THE PREFERRED EMBODIMENT

Figure 1:
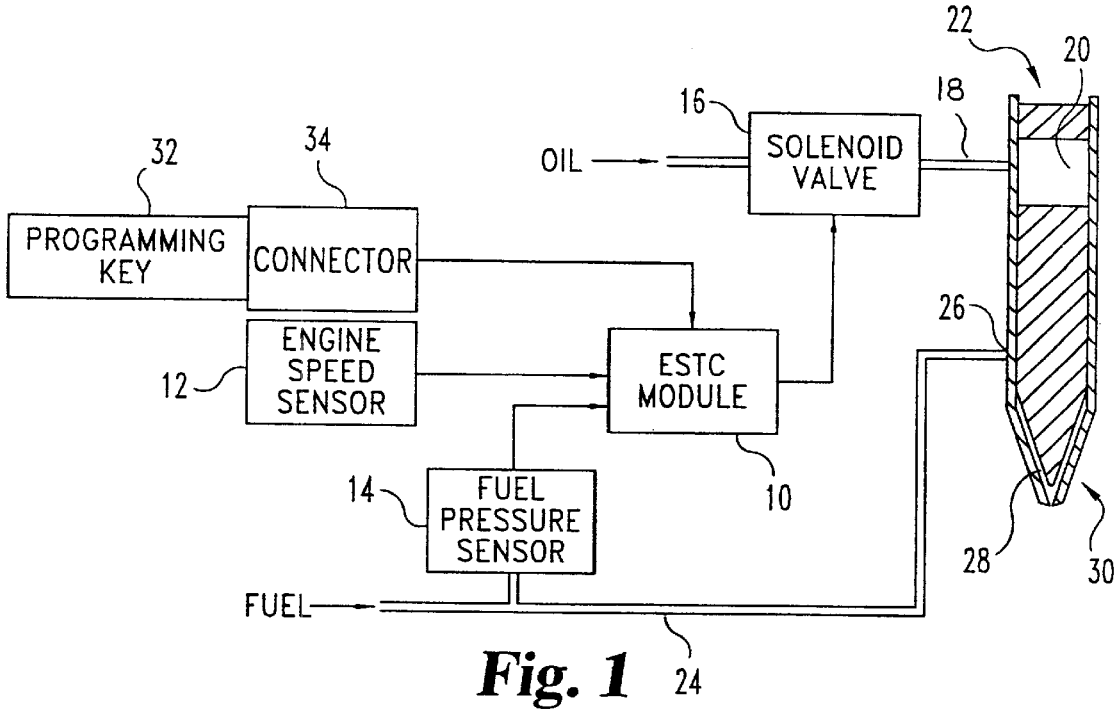
FIG. 1 is a block diagram of the preferred embodiment of an electronic step timing control system according to the present invention.

With reference to FIG. 1, the preferred embodiment of an electronic step timing control (ESTC) system according to the present invention includes an ESTC module 10 which receives input signals from an engine speed sensor 12 and a fuel pressure sensor 14 and supplies a control signal to a solenoid valve 16 for control of injection timing. The solenoid valve is connected in a conventional manner to supply a timing fluid, preferably engine lubrication oil, through a hydraulic line 18 to a hydraulic tappet 20 in a fuel injector 22 to advance the injection timing. Valve 16 is preferably a normally closed solenoid valve. When closed, the valve blocks oil flow to the hydraulic tappet and thereby maintains retarded timing. When the solenoid is energized, the valve opens and allows oil flow to the tappet through a check valve (not shown) in the injector and thus advances the timing.

Suitable solenoid valves are commercially available, for example, from Cummins Engine Company as part numbers 4010194 and 401095. Injector 22 is a conventional unit injector suitable for hydraulic variable timing, and may be a Cummins PT STC injector having one of the following part numbers: 3087648, 3406604 or 3406707.

Fuel is supplied from a conventional hydromechanical fuel pump, e.g., a Cummins PTG pump, to a fuel rail 24 which is connected to a metering inlet 26 in injector 22, which contains an internal passageway (not shown) between inlet 26 and a cup 28 in the injector tip 30. The rail pressure is measured with fuel pressure sensor 14, which may be an analog sensor, e.g., Cummins part number 3080416. Engine speed sensor 12 is preferably of the type generating pulses in response to flywheel motion and is mounted adjacent the engine flywheel in a known manner. A suitable sensor of this type is Cummins part number 3078155.

As will be described, the ESTC module is programmable by means of a programming key 32 inserted in a programming connector 34. ESTC module 10 is preferably integrally connected to programming connector 34 by a wiring harness that also includes connectors for sensors 12 and 14, a fuse, and terminals for connection to solenoid valve 16 as well as to vehicle electrical power and ground.

Figure 2:
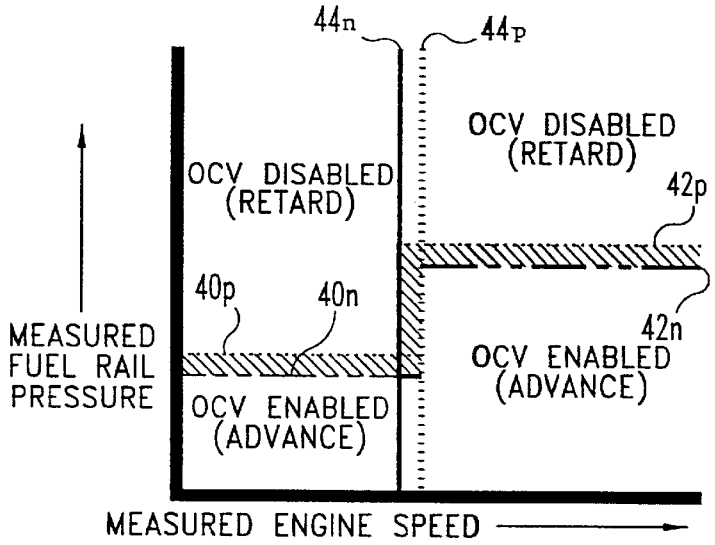
FIG. 2 is a graphical illustration of the operating characteristic of a speed-sensitive fuel pressure level detector according to the preferred embodiment the present invention.

ESTC module 10 includes a variable-threshold level detector having an operating characteristic as indicated graphically in FIG. 2. As disclosed, two discrete pressure thresholds are provided for respective engine speed ranges, although the invention is not intended to be limited to two thresholds. In general, when engine speed is less than a predetermined speed threshold, injection timing is retarded if the measured fuel rail pressure is greater than a predetermined lower fuel pressure threshold, and is otherwise advanced. When engine speed is greater than the speed threshold, injection timing is retarded if the rail pressure is greater than a predetermined upper fuel pressure threshold, and is otherwise advanced. The general logic function is indicated in FIG. 2 by reference to the following states of the solenoid valve, or oil control valve (OCV): disabled (retard) and enabled (advance).

More specifically, hysteresis is included in the logic function for greater system stability. That is, the fuel pressure level at which the control valve is commanded to change state as fuel pressure increases is greater than that at which the change of state occurs as fuel pressure decreases. Thus, for lower engine speeds, the level detector has a positive-going pressure threshold 40*p* and a lower negative-going threshold 40*n*. Similarly, the level detector has discrete thresholds 42*p* and 42*n* for higher engine speeds. In addition to the pressure hysteresis just described, speed hysteresis is also provided as indicated by discrete positive-going and negative-going thresholds 44*p* and 44*n*, respectively.

The above-described logic function may be implemented with analog circuitry, e.g., an analog level detector, but is preferably implemented with digital logic, and most preferably with a microprocessor. The control module includes an A/D converter, either internal or external to the microprocessor, for conversion of the analog input signal from pressure sensor 14.

Figure 3:
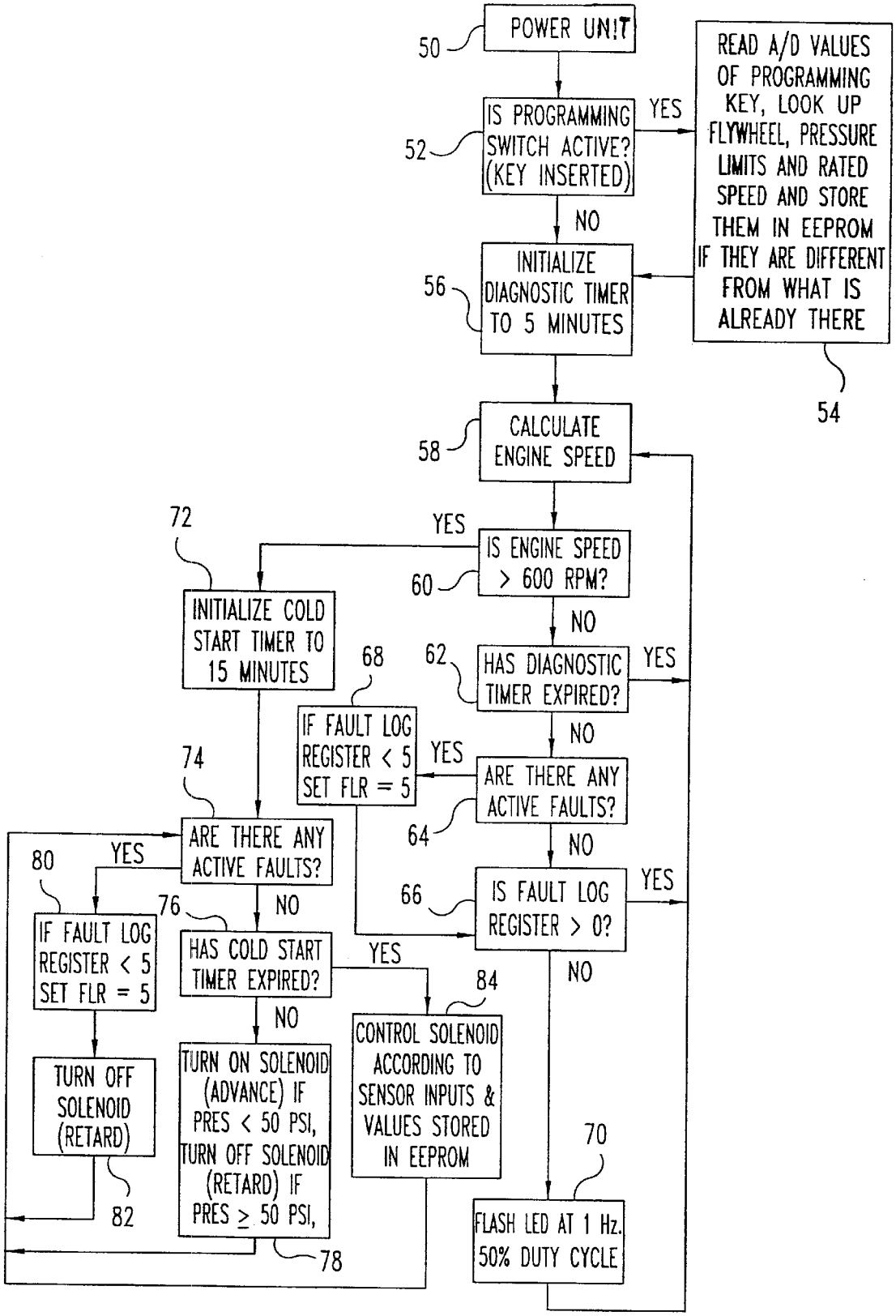
FIG. 3 is a flow chart of a control program executed by the electronic step timing control module of FIG. 1.

Referring to FIG. 3, ESTC module 10 preferably includes a microprocessor programmed to implement the above-described logic function and also execute other instructions in accordance with the illustrated flow chart to perform certain diagnostic functions and to provide appropriate timing control in cold starting conditions as will be described. A suitable microprocessor for such purposes is Microchip Technology Inc. part number PIC12CE674 or an equivalent thereof. The ESTC module preferably contains the following memory: 2k bytes of EPROM for the program code, 16 bytes or more of serial EEPROM for diagnostic and calibration data retention, and 128 bytes or more of RAM.

Upon power-up at step 50, the processor enters a diagnostic mode during which it is capable of detecting the following faults: an overspeed condition, pressure sensor out of range, failed speed sensor, and an unprogrammed module. An address in EEPROM is used as a fault log register to retain a record of faults while the module is powered down. If the value stored in this register is greater than zero at power-up, it is decreased by one at that time to facilitate problem diagnosis, as will be explained. In step 52, the processor then checks for a key in the programming connector. If a key is detected, program execution proceeds to step 54, in which the processor reads the data in the key.

A programming key contains data in the form of resistors having values representative of desired values of pressure and speed thresholds and a speed calibration factor. Individual resistors may be incorporated in a key for each parameter, but it is preferred to combine parameters and thereby reduce the number of resistors in any given key. One or both nominal fuel pressure thresholds may be designated in a single resistor along with, for example, the number of teeth on the engine flywheel, which number is used to calibrate the engine speed sensor. As a more specific example, one resistor may designate the flywheel and lower pressure threshold, and a second resistor may designate an engine's rated speed which is used to determine the engine speed threshold, with example values as set forth below:

TABLE 1

| PROGRAMMING KEY | | | | |
|---|---|---|---|---|
| R1 | Flywheel | Lower Pressure Threshold | R2 | Rated Speed |
| 1K | 103 tooth | 23 psi | 1K | 1830 rpm |
| 6.2K | 103 tooth | 27 psi | 6.2K | 2030 rpm |
| 18K | 118 tooth | 23 psi | 18K | 2130 rpm |
| 100K | 118 tooth | 27 psi | 100K | 1730 rpm |

A three-cavity Deutsch connector (DTO4-3P) is suitable for such purposes. The processor is further programmed to inhibit response to a programming key until it has detected an authorization key in connector 34. This feature prevents unauthorized recalibration, or reprogramming, of the module by individuals gaining access to a programming key from another engine, for example. The processor may be programmed simply to inhibit response or to clear the existing calibration data in response to an authorization key. In either event, when a programming key is read after an authorization key, the processor stores any new values in memory in step 54.

A diagnostic timer is initialized in step 56, which is performed immediately after step 52 if a key is not detected in that step. The processor thereupon calculates engine speed in step 58 and executes a conditional branch at step 60 depending on the current value of calculated engine speed. The processor calculates engine speed on the basis of the incoming pulses from the speed sensor and the stored flywheel parameter in a known manner. At engine speeds below a predetermined value, which is 600 rpm as illustrated in FIG. 3 but may be a higher or lower value intended to reflect that the engine has started, the processor checks the diagnostic timer in step 62, proceeding to step 64 if the time has not expired and returning to step 58 if the time has expired. Programmed as illustrated, the processor stays in the diagnostic mode for 5 minutes or until the engine speed exceeds 600 rpm.

If no active faults are detected in step 64, program execution proceeds directly to step 66. On the other hand, if there are any active faults, the value in the fault log register (FLR) is first set equal to 5 in step 68 if currently less than 5. In either event, the fault log register is checked in step 66. If the value in the register is zero, an LED is caused to flash. If the value is nonzero, the program returns to step 58. The processor is programmed to turn the LED off in the latter situation unless the module is unprogrammed, in which case the LED is held continuously on. A nonzero value in the fault log register can be decremented by one by restarting the program, i.e., by removing power from the module and reapplying power. Thus, if the LED is off, an operator can determine if the LED is indicating an active fault or a historic fault by cycling the module power on and off 5 times. If the LED remains off, there is an active fault or a fault within the last 5 cycles. If the LED starts flashing, there is no active fault and no faults within the last 5 cycles.

The ESTC module also has a cold start mode which it enters the first time during each power-up that the engine speed is greater than 600 rpm, and which it automatically exits after 15 minutes. The cold start timer is initialized in step 72, after which the processor checks for active faults in step 74. If there are no active faults and if the time has not expired (step 76), the fuel pressure threshold is set to 50 psi, for example, and in step 78 the injection timing is advanced if the fuel pressure is below that threshold and retarded if the fuel pressure is above that threshold. If there are any active faults when step 74 is performed, the value in the fault log register is set equal to 5 in step 80 if currently less than 5, and the solenoid valve is deenergized in step 82 to retard the injection timing. After either step 78 or step 82, program execution returns to step 74. If there are no active faults and the cold start time has expired, program execution then proceeds to step 84, whereupon the solenoid valve is controlled according to the speed and pressure inputs, the speed and pressure thresholds and flywheel parameter stored in EEPROM, and the presence or absence of an active fault.

Figure 4:
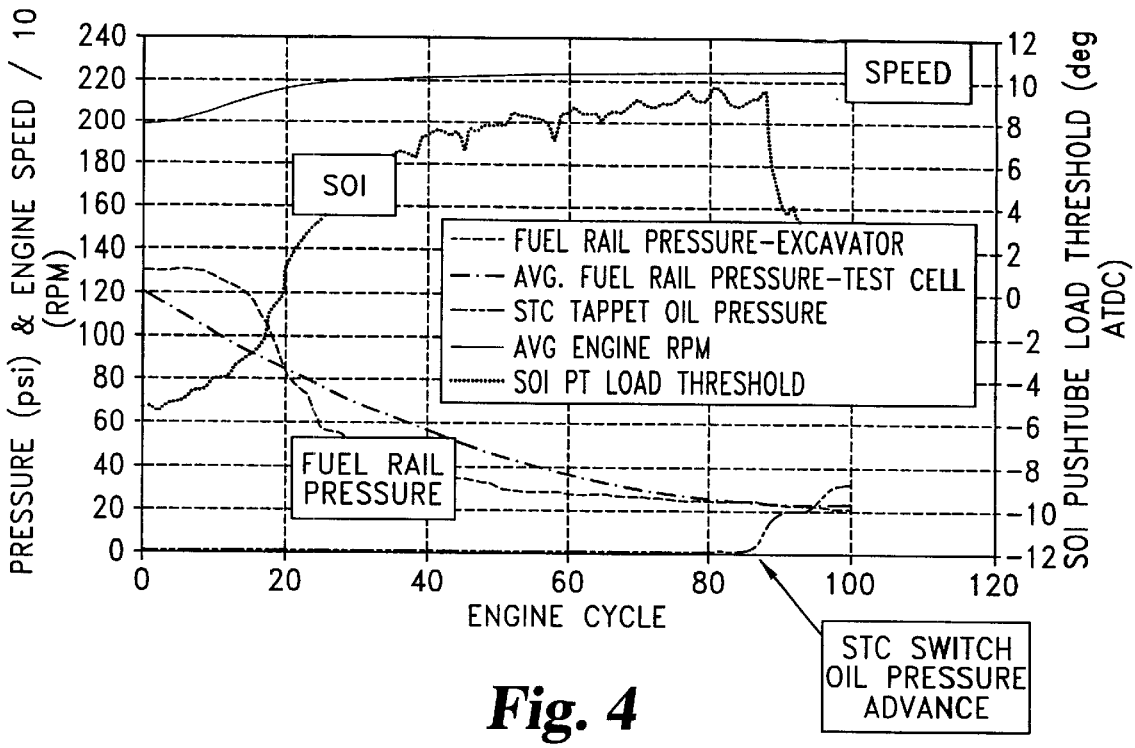
FIGS. 4 and 5 are transient response curves for an existing step timing control system and for the preferred embodiment of an electronic step timing control system according to the present invention.
Figure 5:
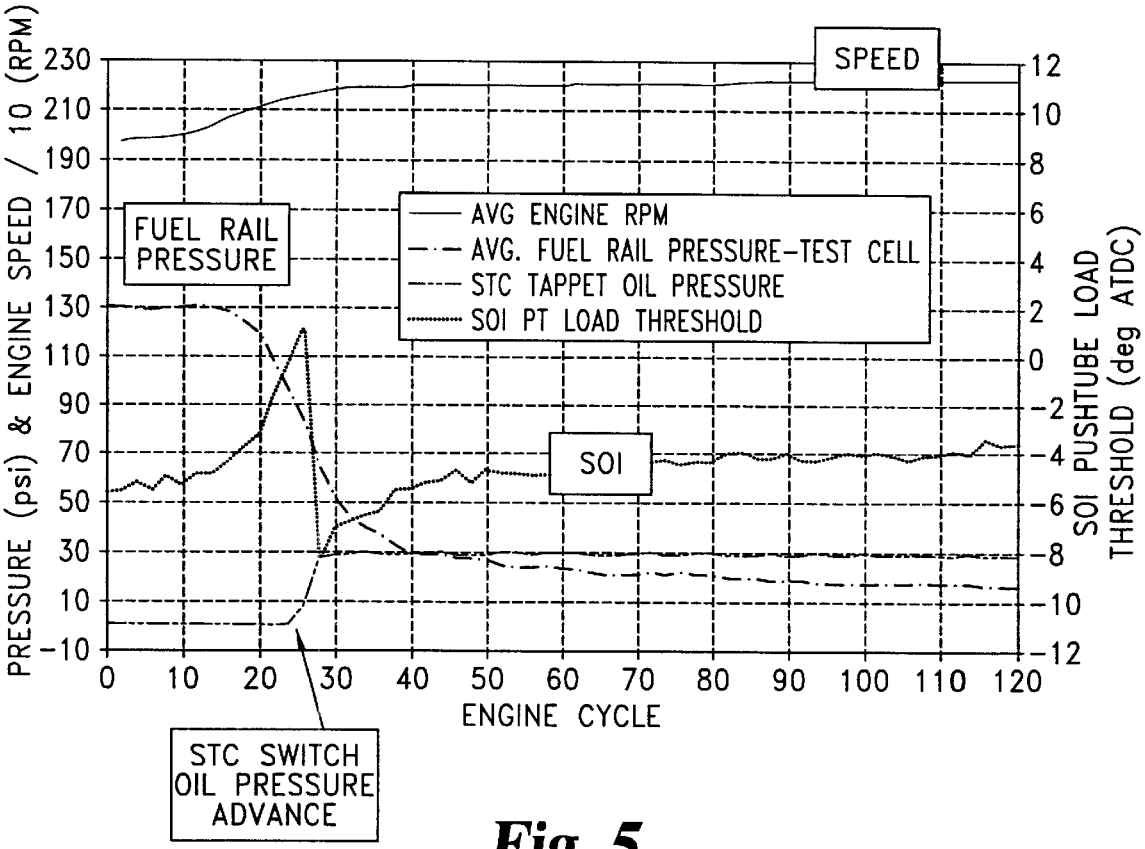

FIG. 4 illustrates the transient response of an STC system having only a single fuel pressure threshold—27 psi—and particularly illustrates the delayed reaction of the control valve. FIG. 5 illustrates the transient response of an ESTC system according to the present invention. In the disclosed example, the system has a nominal lower fuel pressure threshold of 27 psi and a nominal upper fuel pressure threshold of 85 psi, and a speed threshold approximately 30 rpm above rated speed.

We claim:

1. An electronic step timing control system for control of injection timing in a fuel system of the type including a hydromechanical fuel pump and governor and at least one fuel injector having a hydraulic tappet, said electronic step timing control system comprising:

an ON-OFF solenoid valve for supplying timing fluid to said hydraulic tappet and thereby advancing injection timing; and electronic circuit means for controlling said solenoid valve as a function of fuel pressure and engine speed, said electronic circuit means including a fuel pressure level detector having a threshold that is electronically variable as a function of engine speed.

2. The system of claim 1, wherein said fuel pressure threshold is discretely variable as a function of engine speed.

3. The system of claim 1, wherein said fuel pressure threshold has a higher value above a predetermined speed threshold than below said predetermined speed threshold.

4. The system of claim 1, wherein said fuel pressure level detector has pressure hysteresis and speed hysteresis.

5. The system of claim 1, further comprising a programming key containing data representative of at least one desired value of said fuel pressure threshold and a desired value of said speed threshold, wherein said electronic circuit means includes connector means for receiving said programming key, and means for controlling operation of said fuel pressure level detector in accordance with said key data.

6. The system of claim 1, wherein said electronic circuit means includes a memory for storing said fuel pressure threshold and said speed threshold.

7. The system of claim 1, wherein said electronic circuit means includes means for inhibiting response to a programming key prior to detection of an authorization key in said connector means.

8. The system of claim 1, wherein said electronic circuit means energizes said solenoid valve so as to produce advanced injection timing when the fuel pressure is below a selected one of a plurality of pressure thresholds.

9. An electronic step timing control system for control of injection timing in a fuel system of the type including a hydromechanical fuel pump and governor and at least one fuel injector having a hydraulic tappet, said electronic step timing control system comprising:

an engine speed sensor;

a fuel pressure sensor;

an ON-OFF solenoid valve for supplying timing fluid to said hydraulic tappet and thereby advancing injection timing; and an electronic control circuit having inputs connected to said engine speed sensor and said fuel pressure sensor and an output connected to said solenoid valve, said electronic control circuit including a fuel pressure level detector having a threshold that is electronically variable as a function of engine speed.

10. The system of claim 9, wherein said fuel pressure threshold is discretely variable as a function of engine speed.

11. The system of claim 9, further comprising a programming key containing data representative of at least one desired value of said fuel pressure threshold and a desired value of said speed threshold, wherein said electronic circuit means includes connector means for receiving said programming key, and means for controlling operation of said fuel pressure level detector in accordance with said key data.

12. The system of claim 9, wherein said electronic circuit means includes a memory for storing said fuel pressure threshold and said speed threshold.

13. The system of claim 9, wherein said electronic circuit means includes means for inhibiting response to a programming key prior to detection of an authorization key in said connector means.

14. A reprogrammable electronic step timing control system for control of injection timing in a fuel system of the type including a hydromechanical fuel pump and governor and at least one fuel injector having a hydraulic tappet, said electronic step timing control system comprising:

an ON-OFF solenoid valve for supplying timing fluid to said hydraulic tappet and thereby advancing injection timing; and electronic circuit means for controlling said solenoid valve as a function of fuel pressure and engine speed, said electronic circuit means including a fuel pressure level detector having a threshold that is electronically variable as a function of engine speed, programming connector means for receiving a programming key containing data representative of at least one desired value of said fuel pressure threshold and a desired value of a speed threshold, and means for controlling operation of said fuel pressure level detector in accordance with said key data.

15. The system of claim 14, wherein said electronic circuit means includes a memory for storing said fuel pressure threshold and said speed threshold.

16. The system of claim 14, wherein said electronic circuit means includes means for inhibiting response to a programming key prior to detection of an authorization key in said connector means.

17. A step timing control method for control of injection timing in a fuel system of the type including a hydromechanical fuel pump and governor and at least one fuel injector having a hydraulic tappet, said method comprising:

supplying timing fluid to said hydraulic tappet through an ON-OFF solenoid valve to advance injection timing; and controlling said solenoid valve as a function of fuel pressure and engine speed, said controlling step including electronically comparing sensed fuel pressure with a fuel pressure threshold, and electronically varying said fuel pressure threshold as a function of engine speed.

18. The method of claim 17, wherein said fuel pressure threshold is varied discretely as a function of engine speed.

19. The method of claim 17, wherein said fuel pressure threshold has a higher value above a predetermined speed threshold than below said predetermined speed threshold.

20. The method of claim 17, further comprising:

decreasing said fuel pressure threshold in response to a positive-going crossing thereof and increasing said fuel pressure threshold in response to a negative-going transition; and decreasing said speed threshold in response to a positive-going crossing thereof and increasing said speed threshold in response to a negative-going transition.

21. The method of claim 17, further comprising:

providing a programming key containing data representative of at least one desired value of said fuel pressure threshold and a desired value of said speed threshold;

inserting said programming key into a programming connector;

reading said key data and setting said fuel pressure threshold and said speed threshold in accordance therewith.

22. The method of claim 17, further comprising the step of electronically storing said fuel pressure threshold and said speed threshold in a nonvolatile memory.

23. The method of claim 17, further comprising the step of electronically inhibiting response to a programming key prior to detection of an authorization key in said programming connector.

* * * * *